US009858836B2

(12) United States Patent
Weight et al.

(10) Patent No.: US 9,858,836 B2
(45) Date of Patent: Jan. 2, 2018

(54) PANELS

(71) Applicant: Spirit Displays Limited, Croydon (GB)

(72) Inventors: Hadley W. Weight, Mitcham Surrey (GB); Alistair N. Weight, Raynes Park (GB)

(73) Assignee: SPIRIT DISPLAYS LIMITED, Croydon (GB)

( * ) Notice: Subject to any disclaimer, the term of this patent is extended or adjusted under 35 U.S.C. 154(b) by 0 days.

(21) Appl. No.: 14/361,771

(22) PCT Filed: Nov. 30, 2012

(86) PCT No.: PCT/GB2012/052959
§ 371 (c)(1),
(2) Date: May 30, 2014

(87) PCT Pub. No.: WO2013/079956
PCT Pub. Date: Jun. 6, 2013

(65) Prior Publication Data

US 2014/0345174 A1 Nov. 27, 2014

(30) Foreign Application Priority Data

Nov. 30, 2011 (GB) ..... 1120660.4

(51) Int. Cl.
*G09F 17/00* (2006.01)
*G09F 15/00* (2006.01)
*G09F 13/04* (2006.01)

(52) U.S. Cl.
CPC ..... *G09F 15/00* (2013.01); *G09F 13/04* (2013.01); *G09F 15/0012* (2013.01); *G09F 15/0025* (2013.01); *Y10T 29/49826* (2015.01)

(58) Field of Classification Search
CPC ..... G09F 15/0025; G09F 15/00
(Continued)

(56) References Cited

U.S. PATENT DOCUMENTS 4,563,542 A * 1/1986 Pollack ..... H02G 3/266 174/68.3
4,629,075 A * 12/1986 Hutten ..... A47G 1/21 211/45

(Continued)

FOREIGN PATENT DOCUMENTS

GB 2382712 A 11/2001
WO 9427273 A1 11/1994

(Continued)

OTHER PUBLICATIONS

Patent Cooperation Treaty Notification of Transmittal of the International Search Report and the Written Opinion of the International Searching Authority, or the Declaration dated Feb. 18, 2013.

(Continued)

*Primary Examiner* — Kristina N Junge
(74) *Attorney, Agent, or Firm* — Bacon & Thomas, PLLC

(57) ABSTRACT

A panel 1 comprises a frame 2 having first and second frame portions 2*a*, 2*b* each provided with a longitudinal channel 7. The panel also comprises sheet material 4 extending across the frame 2 between the frame portions 2*a*, 2*b*. A first edge portion of the sheet material is inserted into the channel of the first frame portion 2*a* and a second edge portion of the sheet material is inserted into the channel of the second frame portion 2*b*. The first edge portion of the sheet material has a region of stiffened edging 6 that is located within the channel 7 of the first frame portion 2*a*. The second edge portion of the sheet material 4 is gripped within a resilient slot formed by a gripper member 5 that provides at least one resilient gripper element 5*b* in the channel 7 of the second frame portion 2*b*.

18 Claims, 7 Drawing Sheets

(58) Field of Classification Search
USPC ..... 40/603; 38/102.1, 102.2
See application file for complete search history.

(56) References Cited

U.S. PATENT DOCUMENTS

| | | | | |
|---|---|---|---|---|
| 4,986,013 | A * | 1/1991 | Pollack | A47G 1/0605 40/606.17 |
| 5,398,388 | A * | 3/1995 | Coleman | 24/593.11 |
| 5,584,461 | A * | 12/1996 | Pynenburg | G09F 15/0018 24/498 |
| 5,647,155 | A * | 7/1997 | Hillstrom | 40/603 |
| 6,061,941 | A * | 5/2000 | Verret | 40/603 |
| 6,088,942 | A * | 7/2000 | Brooks | G09F 15/0025 160/328 |
| 6,209,245 | B1 * | 4/2001 | Wittenberg | 40/603 |
| 8,595,966 | B2 * | 12/2013 | Breihof | 40/603 |
| 8,702,051 | B2 * | 4/2014 | Vanham | 248/477 |
| 2006/0242805 | A1 * | 11/2006 | Coleman | 24/462 |
| 2011/0185610 | A1 * | 8/2011 | Froio | G09F 15/00 40/606.17 |

FOREIGN PATENT DOCUMENTS

| | | | |
|---|---|---|---|
| WO | 0213172 | A1 | 2/2002 |
| WO | 03088196 | A1 | 10/2003 |
| WO | 2006010168 | A1 | 1/2006 |
| WO | 2009130489 | A1 | 10/2009 |
| ZA | 200405842 | B | 7/2005 |

OTHER PUBLICATIONS

Intellectual Property Office letter regarding Application GB1120660.4 dated Apr. 12, 2013.

* cited by examiner

PANELS

This invention relates to panels, for example, panels formed by stretching sheet material across a frame. Such panels can be used for advertising panels, signs, illuminated displays, luminaires, graphic displays, covers, wall partitions, filters, screens, mesh, stretched ceilings and acoustic panels, among other applications. The invention also relates to a kit of parts for assembling such panels.

Panels comprising a frame provided with a channel around an edge in which sheet material is held by a gripper member are known. In such systems, the gripper member is in the form of a plug that is pushed into a channel of an extruded frame to trap an edge of the sheet material, for example, as in the panel illustrated in AU-B-2005100581.

Another similar system is available from Spirit Displays Ltd. and marketed under the name "SpiritTex". It comprises a set of extruded frame members that can be assembled into a rectangular frame. The frame members each comprise a longitudinal channel that holds a length of a moulded gripper member. The gripper member has a substantially tubular form. However it is moulded so as to provide a resilient slot along its length where one edge naturally tends to lie below the other to close off the slot. Sheet material is inserted into the slot of the gripper member and is held there by the grip of the two slot sides. By urging the sheet material into the slot all around the frame, the sheet material can be pulled taut and may be held under tension.

This method of assembly, while being simple and not requiring any modification of the sheet material, involves some skill on the part of the fitter in order to align a printed image on the sheet material with respect to the frame.

Another disadvantage is that the form of the gripper member and the frame, in situations when the panel is illuminated from the reverse side, results in a noticeable region around the edge of the panel where the edge of the display on the panel is not illuminated because the frame obstructs the illumination.

A further system is disclosed in ZA 2004/5842. This system includes an extruded portion having a longitudinal passage for receiving a bead (or keder strip) formed at an edge of sheet material. The edge of the sheet material provided with the bead is anchored into the extruded portion by sliding the bead into the longitudinal passage. The extruded portion is then located within a longitudinal channel provided in a first extruded frame member. To anchor another edge of the sheet material, a second extruded frame member (with may have the same cross-sectional profile as the first extruded frame member) is provided. The sheet material is pulled taut above and across the mouth of the longitudinal channel provided in the second frame member, and a gripper member in the form of a longitudinally extending flexible plug member is pushed down onto the sheet material and into the longitudinal channel. The plug includes formations for forming a force fit within the channel, thereby trapping the sheet material in position in the channel.

This problem with this system is that a region of bordering is created around the edges of the sheet material by the plug members. This reduces the display area of the frame, and also may be less aesthetically pleasing.

It is also known to provide a region of stiffened edging, which may be in the form of a strip of material, around each edge of the sheet material that fits into correspondingly sized channels of a frame. The stiffened edges have the benefit that they allow the flexible sheet material to be aligned easily in the frame. However, the positioning of the stiffened edges with respect to the sheet material needs to be accurate. The stiffened edges must be provided to correspond closely to the dimensions of the frame, in particular so that they can be fitted into the channel, and in doing so pull the material taut. Any looseness in the sheet material will make the panel look baggy and undesirable. Similarly if the stiffened edges are not far enough apart then there may be difficulties in fitting the sheet material to the frame. Typically the sheet material may be temperature sensitive. Differing rates of shrinkage or stretching can occur due to temperature treatment during or post production of the sheet material or during other working such as dyeing, colouring, printing or coating. This can mean the final sheet material no longer fits the designated frame and is unusable. This can result in significant production losses and returns. Shrinkage and stretching of such sheet material especially textiles and fabrics is well documented.

Thus it would be desirable to provide a panel that allows for easier alignment of the sheet material while avoiding some of the problems associated with shrinkage of the sheet material.

Thus, according to a first aspect of the present invention, there is provided a panel comprising:

- a frame having a first frame portion and a second frame portion, the first and second frame portions each being provided with a longitudinal channel,
- sheet material extending across the frame between the frame portions, wherein a first edge portion of the sheet material is inserted into the channel of the first frame portion and a second edge portion of the sheet material is inserted into the channel of the second frame portion,
- wherein the first edge portion of the sheet material has been adapted to create a region of stiffened edging that is located within the channel of the first frame portion and the second edge portion of the sheet material is gripped within a resilient slot formed by a gripper member that provides at least one resilient gripper element in the channel of the second frame portion.

The panel may be supplied in kit form for assembly on-site, as an assembled frame and separate sheet material, or as a completed panel with the sheet material in place.

Thus viewed from a second aspect the present invention provides a kit of parts for a panel comprising:

- one or more frame members which can be assembled into a frame, the frame having a first frame portion and a second frame portion, which is preferably arranged opposite the first frame portion when the frame is assembled, the first and second frame portions each being provided with a longitudinal channel,
- sheet material which is sized to extend across the frame when a first edge portion of the sheet material is inserted into the channel of the first frame portion and a second edge portion of the sheet material is inserted into the channel of the second frame portion,
- wherein the first edge portion of the sheet material has been adapted to create a region of stiffened edging that locates within the channel of the first frame portion,
- and a gripper member is provided that has at least one resilient gripper element for mounting in the channel of the second frame portion, the resilient gripper element forming a resilient slot in the channel that receives and grips the second edge portion of the sheet material in use.

Viewed from a third aspect, the present invention can also be seen to provide a method of assembling a panel comprising:

assembling a frame having at least a first frame portion and a second frame portion, the first frame portion preferably being located within the assembled frame generally opposite the second frame portion, each frame portion having a channel, providing a gripper member that forms a resilient slot in the channel of the second frame portion;

providing sheet material to extend between the first and second frame portions to form a body of the panel, the sheet material having a first edge portion and a second edge portion, wherein the first edge portion of the sheet material has been adapted so as to provide a region of stiffened edging;

inserting the region of stiffened edging into the channel of the first frame portion in order to locate the first edge portion of the sheet material with respect to the panel;

inserting the second edge portion of the sheet material into the resilient slot provided by the gripper member of the second frame portion to locate the second edge portion of the sheet material with respect to the panel; and pulling the sheet material taut through pushing the second edge portion of the sheet material into the gripper member of the second frame portion.

According to a fourth aspect of the present invention, there is provided a panel comprising:

a frame having a first frame portion and a second frame portion, the first and second frame portions each being provided with a longitudinal channel, a gripper member comprising a gripper element, the gripper element being located within the channel of the second frame portion to form a resilient slot therein, and sheet material extending across the frame between the frame portions, wherein a first edge portion of the sheet material has been adapted to create a region of stiffened edging, said first edge portion of the sheet material being located within the channel of the first frame portion, and wherein the resilient slot provided by the gripper element is arranged to receive and grip the second edge portion of the sheet material when the second edge portion of the sheet material is inserted into the resilient slot.

The present invention has the advantage that alignment of at least one edge can be achieved easily and reliably by engaging the edge of the sheet material with the region of stiffened edging in the channel of the first frame portion. The remaining edges or section of edge can then be eased into a resilient slot formed by the gripper member or members around the perimeter of the frame and the sheet material pulled taut. It allows the sheet material to be made slightly over-sized and any excess material can be held out of sight within the channel of the frame. The ease of fitting and the additional manufacturing tolerance to shrinkage in the sheet material offers significant advantages over the known systems described above. Moreover the internal regions of the frame that underlie the sheet material can be made of a reduced width, reducing the amount of the sheet material that would be obscured from back illumination at the edges of the panel. As with the prior art systems, the panel can also be disassembled quickly and a new display erected easily.

Examples of suitable applications for the panel of the present invention are: advertising panels, signs, illuminated displays, luminaires, graphic displays, covers, wall partitions, filters, screens, meshes, ceiling panels, acoustic panels, or other similar items. If desired, these may be back-lit, for example, by one or more lamps or other form of illumination provided within the panel or through light projected onto the panel from a distance, e.g., as a cinema screen or the like to form an illuminated sign, or a luminaire. Small lights could be provided under the sheet material for use in an informative or decorative display to highlight parts. In other embodiments, the panel may include thermal insulation or acoustic insulation, for example, where it is being used as a ceiling or wall panel. Indeed the sheet material could be used to conceal pretty much anything in addition to providing a visually attractive display.

Preferably the panel is rectangular. For example, the panel may comprise four frame members that are fixed together to create a rectangular frame for the panel. However, the panel may be any shape, for example, triangular, hexagonal or indeed any other polygonal shape. Each frame portion may correspond to a complete side of that shape and comprise a single frame member. The first and second frame portions (e.g., the frame members or portions of the frame members) may be arranged adjacent to each other (e.g., in the case of a triangular frame or the adjacent sides of a rectangular frame) or, more usually, the first and second frame portions will be held spaced from each other by further frame portions or frame members (e.g., opposite sides in the case of a rectangular frame). Thus the first frame portion is preferably located generally opposite to the second frame portion but the second frame portion may also refer to regions of the frame that are located on either side of the first frame portion.

Each edge of the sheet material preferably provides an edge portion that is inserted in a side of the frame. However, it is possible for one or more edges to be unsecured within a region of the frame. For example, it may be desired to only have the top and bottom or the left and right sides of a rectangular panel secured within the frame.

The frame of the panel may also be curved, circular or elliptical. In these situations each of the first and second frame portions may correspond to a different region of the same frame member. Similarly the edge portions of the sheet material may correspond to different regions of a curved edge (e.g., in the case of a circular frame).

Any curvature in the panel may be in two dimensions or three as desired. Thus while in most embodiments the panel is preferably fully planar or substantially planar, it could also be non-planar in the sense of having a significant degree of curvature. The panel may also be any size and may be self-supported or fixed to a wall or other structural support, that support being fixed (for example, as a fixed sign) or moveable (for example, the side of a vehicle).

In one embodiment, a gripper member is not provided in the first frame portion but is only provided in the remaining regions of the frame (i.e., the second frame portion or portions) to form a resilient slot or slots in the channel. The gripper member is able to grip hold of and retain an edge portion of the sheet material even if it does not include a region of stiffened edging.

In another embodiment, gripper members are provided in the channels of both the first and second frame portions, e.g., around the whole of the frame. The respective gripper member then grips the edge of the sheet material, regardless of whether it also includes a region of stiffened edging for setting the alignment of the sheet material, and is able to keep the sheet material taut within the panel.

In the case of a panel with a plurality of sides, where the sheet material is held at each edge corresponding to each side of the panel, for example, the four edges of a four-sided rectangular frame, the or each gripper member may be arranged so that a resilient gripper element is provided in the channels on all sides of the frame. More preferably three gripper members are provided in a rectangular frame, each gripper member having at least one resilient gripper element that is located in a channel. In this way, one edge of the sheet material is located in a predetermined position through the region of stiffened edging locating within the channel, and the remaining edges of the sheet material are subsequently fixed in place by being pushed into a resilient slot that extends around the remainder of the frame.

Thus viewed from another aspect, the present invention can also be seen to provide a panel comprising a frame and an expanse of sheet material which attaches to the frame, wherein a first portion of the frame is provided with means for mounting a first edge of the sheet material in a predetermined position with respect to the frame, and a second portion of the frame is provided with a resilient slot for receiving a second edge of the sheet material.

Any preferred features discussed in relation to this aspect apply equally to the other aspects and vice versa. For example, preferably the frame has a channel for receiving an edge of the sheet material that has been adapted with the provision of the region of stiffened edging and the resilient slot is provided by a gripper member having a gripper element located within a channel of the second frame portion.

The or each region of stiffened edging may lie at an edge of the sheet material or close to an edge of the sheet material, for example, within 50 mm, more preferably within 30 mm from a true edge of the sheet material.

The thickness of the region of stiffened edging may be substantially equal to the width of the channel in the first frame portion. In this scenario, a gripper member is not required for the first frame portion. Instead the sheet material is held within the channel by an interference fit of the region of stiffened edging and the channel. The fit can be a reasonably loose fit if desired as the pull from tension in the sheet material is typically at right angles to the depth of the channel and the width of the region of stiffened edging. Preferably the depth of the channel is greater than the width of the channel, more preferably by a factor of two or more. Correspondingly, preferably the width of the region of stiffened edging is greater than the thickness of the region of stiffened edging, more preferably by a factor of two or more. If the thickness of the region of stiffened edging is significantly less than the width of the channel, a gripper member may be provided in the first frame portion to hold the region of stiffened edging through the grip of the gripper member.

Where a four-sided panel is provided, the region of stiffened edging is applied to one or preferably two edges of the sheet material, in order to enable alignment of the sheet material within the frame. Preferably, the edge(s) opposite to the edge(s) provided with the region of stiffened edging is/are not provided with a corresponding region of stiffened edging. Preferably the sheet material is over-sized to overlap the frame where the edges not provided with a region of stiffened edging.

The sheet material is preferably flexible and may allow a degree of stretch. The sheet material is preferably a fabric or textile, but could be any form of sheet material which can be held by the frame. Examples of suitable sheet materials are: fabrics, foils or films of one or more plies, fabric and film combinations, sheets of man-made materials such as polyester, nylon, elastane, etc, sheets of natural fibres such as cotton, wool or plant fibres, combinations of such materials, other sheet materials like fibreglass and mesh, etc., and may comprise one or more pieces that are joined together. The sheet material may have been subjected to a surface treatment. The sheet material preferably has a design applied thereto, for example by printing. The sheet material may be decorated, patterned or plain.

Preferably the sheet material has been adapted to provide a region of stiffened edging through the application of a strip of material to one or more edges of the sheet material. The region of stiffened edging is preferably formed by attaching the strip to the sheet material by mechanical or chemical means, either just on one side of the strip or, more preferably, by wrapping the sheet material around two main sides of the strip and securing it in place. Examples of mechanical means are stitching, riveting or stapling; examples of chemical means are gluing or welding. The strip may be moulded in a flexible material using an extrusion, pultrusion or similar line process. Examples of suitable flexible materials are: silicone, polymers like polythene, polyethylene, polypropylene and nylon, rubber or rubberised materials, fibre reinforced polymer materials etc., indeed any suitable material that can hold its form and is sufficiently resistant to environmental factors, e.g., metal and wooden strips, webbing, keder, etc. The strip is preferably rectangular in shape, and more preferably corresponds substantially in shape to the channel in the frame portions.

Preferably the frame members are made from a comparatively rigid material, and have preferably been formed by extrusion. Examples of suitable rigid materials are aluminium, titanium or plastic, but other rigid materials may also be used. Each frame portion may comprise one or more frame member that are joined together to form the frame. The material is preferably sufficiently rigid to maintain the shape and dimensions of the frame when the sheet material is pulled taut and/or placed under tension.

Preferably the first and second frame portions are formed from the same extruded profile. Preferably the profile includes a channel. The channel may be substantially perpendicular to a plane defined by the sheet material. The channel may extend at an angle greater than, say, 80° to the plane defined by the sheet material, e.g. preferably 90° where the sheet material slots into the front surface of the panel, but could also include angles such as 180°, 270° where the sheet material wraps around the frame to an extent before engaging the channel.

The channel in the profile may be defined by two walls of the extrusion: an inner wall and an outer wall when viewed in cross-section with respect to the frame. The two walls may be substantially parallel and/or the channel may narrow at its mouth. The outer wall may also define the outer edge of the frame and in one embodiment is substantially rectangular or a rounded rectangular in profile. The inner wall is preferably configured to be engaged by and to retain a gripper member. Preferably the inner wall is shorter than the outer wall. Preferably the inner wall is chamfered at the mouth of the channel to facilitate the location of a gripper member. Preferably the inner wall has a groove on the surface that is exterior to the channel. The groove engages with a rib on a gripper member for securing the gripper member to the frame portion. The gripper member is preferably clipped onto the inner wall and preferably extends substantially the length of the inner wall.

Preferably the or each gripper member is provided as a single-piece profile, and preferably it has been formed by extrusion. The gripper member may have regions that are moulded from different compositions in order to change the properties of those regions. Projections of a more flexible composition may be extruded with a body of a more rigid composition. This may be achieved through varying the composition of a polymer blend or the amount of an elastomer.

The gripper member preferably comprises a plurality of gripper elements, more preferably two or three gripper elements, in the form of flexible, longitudinal projections, more preferably as a flap of substantially the same width (or wider) as the width of the channel provided in the frame portions. These flexible flaps act to close off the channel to provide a resilient slot together with a wall of the channel that the sheet material can be tucked into. With the sheet material bending the gripper element down into the channel, a buckling force of the flap may need to be overcome in order to remove the sheet material. While in the most preferred embodiments the gripper member is arranged to fit over the inner wall of the channel and have the gripper element or elements project across the channel to form a resilient slot with the other side of the channel, embodiments are also envisaged where the gripper member is located wholly or substantially within the channel itself. In these embodiments the gripper member may either provide a wall that forms an opposing edge of the resilient slot or it may provide a further resilient projection, e.g., in the form of a flap or flaps that extend in the opposite direction to the first gripper elements, so that together they provide the opposite sides of the resilient slot. The gripper elements could also comprise other forms of projection that resiliently deflect or deform when the sheet material is inserted, and these may be intermittent or extend continuously along the length of the gripper member.

Preferably, an inner surface of the body of the gripper member is configured to lock onto the frame member, e.g., by corresponding substantially in shape to the frame profile. The gripper member may include a formation that locks onto a feature of the inner wall of the frame member with a snap action.

Preferred embodiments of the invention will now be described in greater detail by way of example only and with reference to the accompanying figures, in which.

Figure 1:
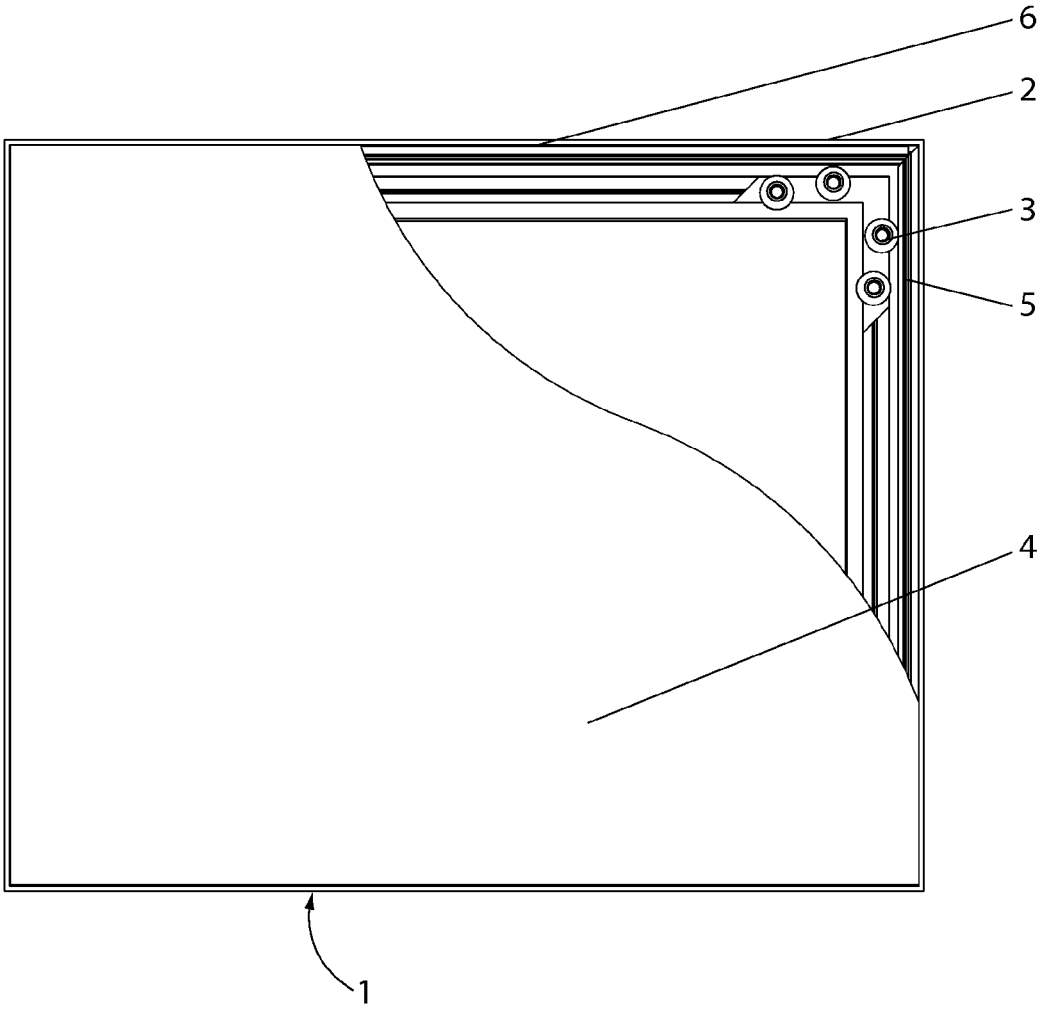
FIG. 1 shows a front elevation of a complete panel according to a first embodiment of the present invention.

FIG. 1 shows a front elevation view of a panel 1 according to a preferred embodiment of the present invention. The panel comprises a frame 2 and sheet material 4. The frame 2 comprises a plurality of extruded aluminium frame members cut with 45° ends which are joined together at the corners of the frame 2 to provide the respective frame portions. In this example, cleats and fixing screws 3 are used to hold the frame portions 2*a*, 2*b* together and to secure the frame 2 to a wall (shown more clearly in FIG. 2).

On one side or two sides of the panel 1, the sheet material 4 is provided with a region of stiffened edging 6. This region of stiffened edging 6 is inserted into a channel 7 to set the alignment of the sheet material 4 easily and in a predetermined manner with respect to the panel. On the other sides of the frame 2, a gripper member 5 associated with a channel 7 forms a resilient slot that the remaining edges of the sheet material 4 can be tucked into, allowing the remainder of the sheet material to be pulled taut within the frame 2.

Figure 2:
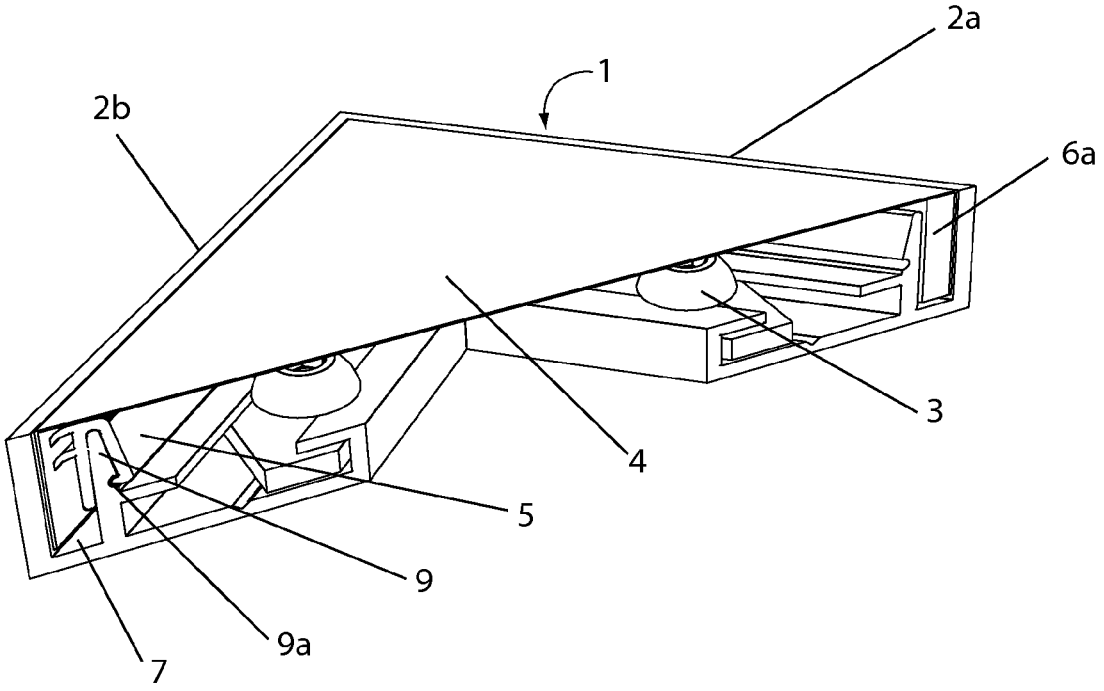
FIG. 2 shows a perspective cut-away view of the panel shown in FIG. 1.

FIG. 2 shows a cut-away perspective view of a corner of panel 1. The figure shows a set of frame members providing a first frame portion 2*a* that is joined to a second frame portion 2*b*. Each frame portion 2*a*, 2*b* has the same frame profile. The profile includes a channel 7 running the length of each frame portion 2*a*, 2*b*. The region of stiffened edging 6 is held within the channel 7 of the first frame portion 2*a* by an interference-type fit. As the tension in the sheet material pulls substantially perpendicularly to the width direction of the region of stiffened edging 6, it does not have to be a completely tight fit within the channel. The second frame portion 2*b* has a gripper member 5 which is provided with one or more gripper elements that form a resilient slot with a side of the channel which holds the remaining edges of the sheet material 4 in place.

Figure 3:
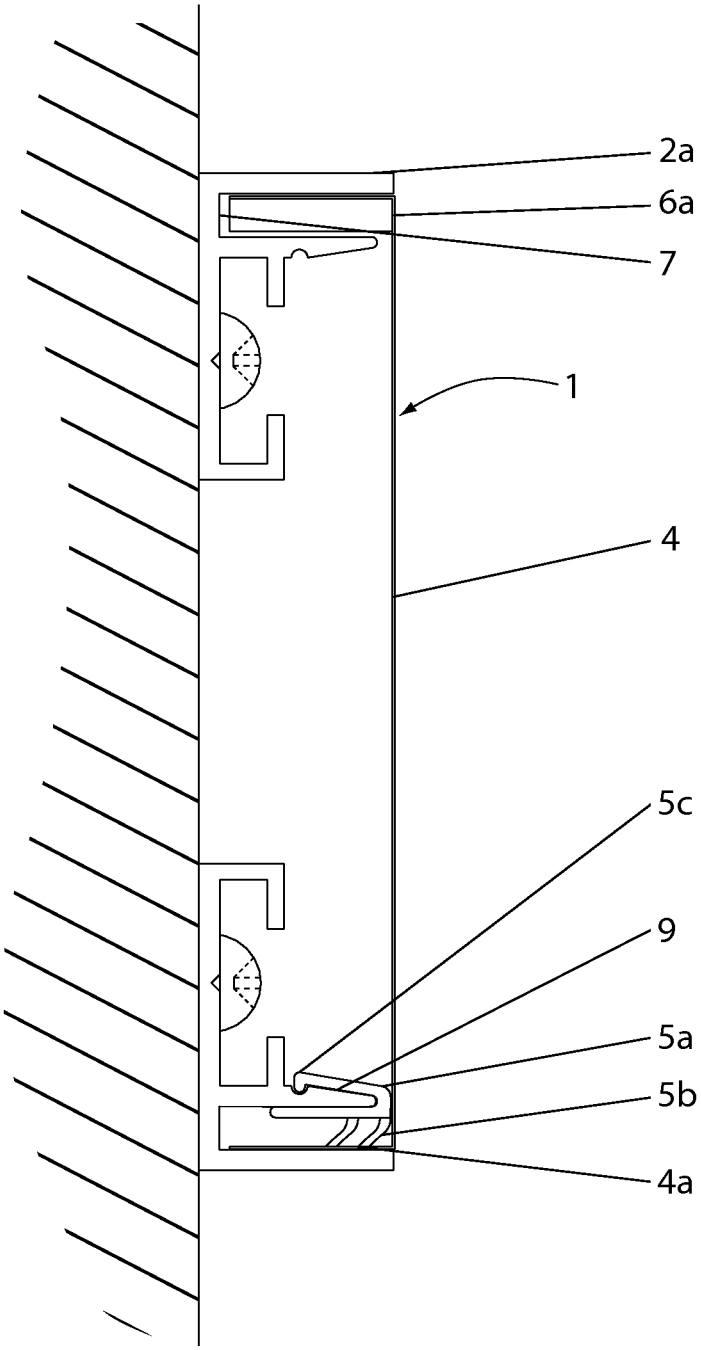
FIG. 3 shows a side view of a panel similar to that shown in FIG. 1.

FIG. 3 shows a side-view of a panel similar to that shown in FIGS. 1 and 2. The gripper member 5 is a single extruded profile comprising a semi-rigid body portion 5*a* and two flexible projections in the form of flaps 5*b*. The body 5*a* of the gripper member 5 has a shape configured to engage with the profile of the frame portion 2*b*. As shown it fits over a wall 9 forming the inside edge of the channel 7. The two longitudinal flaps 5*b* extend a width approximately equal to the width of the channel 7, preferably slightly longer, and so fit tightly within the channel 7. When sheet material 4 is pushed into the channel 7, the flexible projections 5*b* are deflected into the channel 7 to allow the edge of the sheet material 4 to slide past. The flexible projections 5*b* spring back against the sheet material 4 such that the ends of the projections 5*b* resist the removal of the sheet material 4, to keep the panel taut. A tool in the form of blunt blade or spatula can be used to force the sheet material 4 into the frame portions 2*a*, 2*b*.

Figure 4:
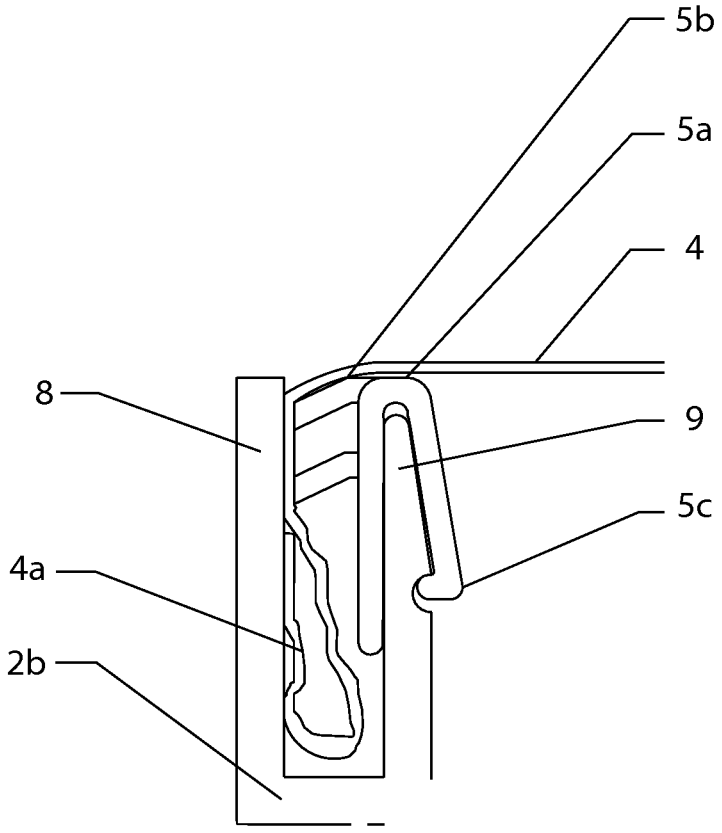
FIG. 4 shows a partial cross-section of a second frame portion illustrating the holding of a second edge of the sheet material according to preferred embodiments of the present invention.

FIG. 4 shows a partial cross-section of a second frame portion 2*b* in more detail. The second frame portion 2*b* is provided with a gripper member 5 that grips the sheet material 4 and holds the excess sheet material 4*a* (the edge being without a region of stiffening edging). The profile of the frame portion 2*b* includes a channel 7 which is defined by two walls 8, 9. The outer wall 8 is rectangular in cross-section. The inner wall 9 is chamfered near the mouth of the channel 7 and has a groove 9*a* on the surface facing into the frame 2, with which the rib 5*c* of the gripper member 5 engages to prevent its removal.

Figure 5:
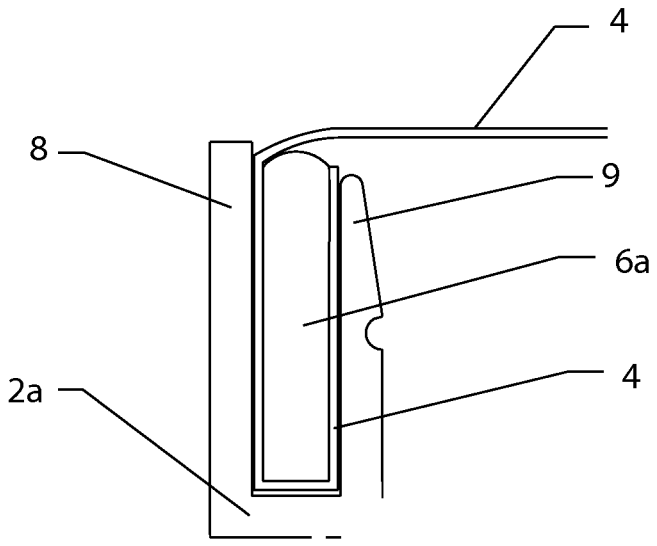
FIG. 5 shows a partial cross-section of a first frame portion illustrating the holding of a first edge of the sheet material of the panel according to a first embodiment of the present invention.
Figure 6:
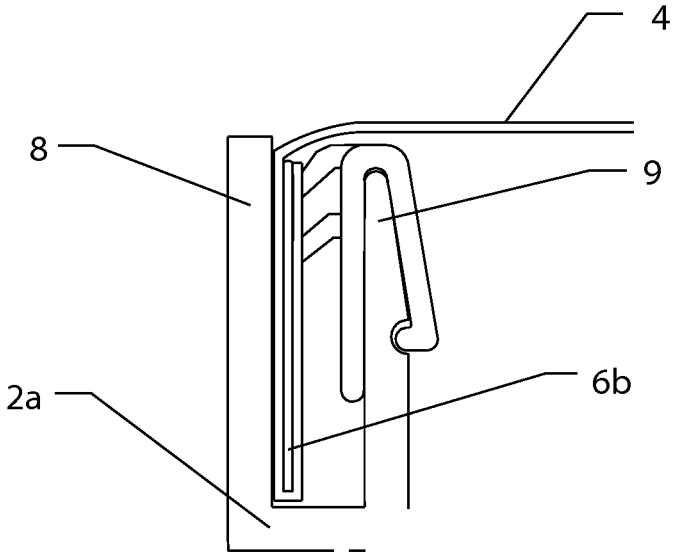
FIG. 6 shows a partial cross-section of a first frame portion illustrating the holding of a first edge of the sheet material according to a second embodiment of the present invention.
Figure 7A:
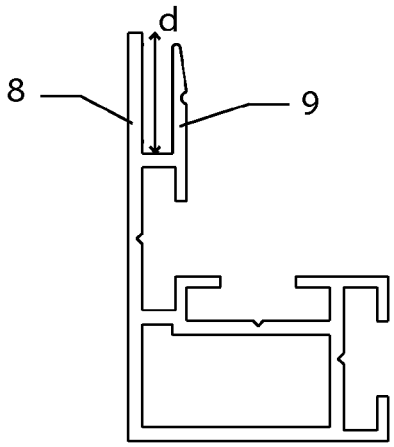
FIGS. 7*a* to 7*e* show cross-sections of frame portions according to further embodiments of the present invention.
Figure 7B:
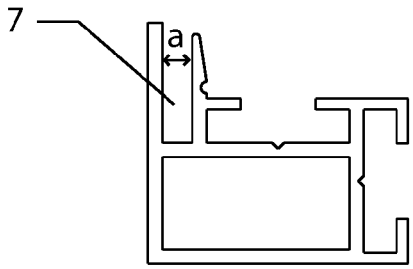
Figure 7C:
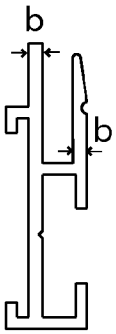
Figure 7D:
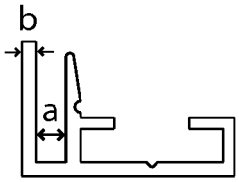
Figure 7E:
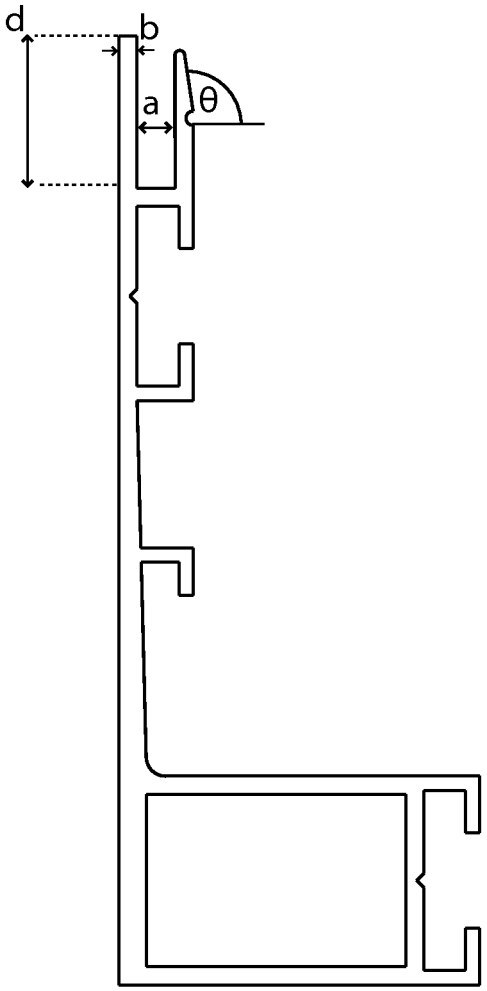

FIGS. 5 and 6 show two possible configurations of the region of stiffened edging 6 held within the first frame portion 2*a*, though other configurations are also envisaged. In the embodiment shown in FIG. 5, the region of stiffened edging 6 is provided as an extruded strip 6*a*, for example, of silicone or plastics, of roughly rectangular profile and of substantially the same dimensions as the channel 7. The strip 6*a* can be attached to the sheet material 4 by mechanical or chemical means (e.g. stitching, stapling, gluing). The strip 6*a* is attached at a predetermined position in order to set the alignment of the sheet material 4 within the panel 1. Once the strip 6*a* is pushed home in the channel 7, the frictional force between the strip and the channel will resist the strip from pulling out during normal use. The region of stiffened edging 6 should be sized so that it can be pushed into the channel 7 by hand, allowing it to be removed easily when required, e.g., to change the display on the panel 1.

In the embodiment shown in FIG. 6, the region of stiffened edging 6 is provided by a thinner strip 6*b* than in FIG. 5, such that the strip 6*b* has a thickness which is substantially less than the width of the channel 7. The first frame portion 2*a* is also provided with a gripper member 5 which has gripper elements to hold the region of stiffened edging 6 in the channel 7. The projections 5*b* form a resilient slot with the channel to resist the sheet material 4 from pulling out. In this embodiment, all sides of the frame 2 would be provided with gripper members 5.

FIGS. 7*a* to 7*e* show example profiles for the frame portions 2*a*, 2*b*. As shown in these figures, the depth d of the channel 7 in the frame portions is greater than the width a of the channel. Preferably, the depth d of the channel 7 is greater than twice the width a of the channel, and more preferably the depth of the channel is greater than three times the width of the channel.

Preferably, the width a of the channel 7 is about 4.0 mm. Preferably the thickness b of the inner and outer walls 8, 9 is about 1.0 to 3.0 mm, more preferably about 1.9 mm.

Preferably the width (corresponding to a+b) of the frame across which the sheet material extends (i.e. the width of the region which cannot be illuminated in situations where the panel is illuminated from behind) is less that 10 mm, more preferably less that 7.0 mm and most preferably less than 5.0 mm.

The chamfered edge of the inner wall 9 is chamfered at an angle (θ) to the perpendicular. Preferably, θ is about 100°, for example 98.6°, though other angles are possible.

The profiles of the frame portions 2*a*, 2*b* are of course not limited to the those disclosed in FIGS. 7*a* to 7*e*. The profiles could take on a range of forms to relate to a specific function or application.

An example method of manufacture and assembly of a panel according to an embodiment of the present invention is as follows.

The dimensions of the panel are determined and a suitable extruded frame profile is selected. Sections of the frame are then fixed together, for example, by joining with cleats and fixing screws or by fixing to a wall. Sheet material 4 is provided that is larger than the area to be covered by the panel. At least one aligning edge of the sheet material 4 is determined and the sheet material 4 is finished with a strip on that edge to provide a region of stiffened edging 6. The remaining edges of the sheet material (in particular those edges opposite to the edge(s) finished with a strip 6) are oversized to overlap the perimeter of the frame. The gripper member 5 is fitted to the frame members of the frame 2 where needed. The sheet material 4 is positioned over the frame 2 and the strip is inserted into the corresponding channel 7 on the frame 2. This provides accurate alignment of this edge of the sheet material. A tool is used to insert the remaining edges of the sheet material 4 into the resilient slots provided by the respective gripper members on the remaining edges. The gripper elements on the gripper members deflect to allow the tool and sheet material 4 to enter. The tool is then removed leaving the sheet material 4 locked in the channel 7 by the flexible projections 5*b*. The process is repeated on all edges until the sheet material has been pulled taut and/or has been put under sufficient tension.

To replace the sheet material 4, for example, to change a display on the panel, then the edges of the sheet material 4 that are held by the gripper members 5 can be pulled out of the resilient slots, the edge with the region of stiffened edging then withdrawn from the frame, and the sheet material 4 replaced for a new one by repeating the installation process described above.

The invention claimed is:

1. A panel having a front surface and comprising:

a frame; and sheet material;

the frame comprising a plurality of frame members assembled into the frame extending around a panel, the frame having a first frame portion provided by a first frame member and a second frame portion consisting of remaining frame members, and each frame member being provided with a longitudinal channel;

the sheet material having edges defining a periphery of the sheet material, the sheet material extending in a plane across the frame between the frame portions, wherein a first edge forming a first edge portion of the sheet material is inserted into the channel of the first frame member, and a second edge portion of the sheet material consisting of remaining edges is inserted into the channels of the remaining frame members, such that the sheet material is retained about its entire periphery by being inserted into the channels of respective frame members of the first and second frame portions;

wherein each channel is defined by two walls of the respective frame member, an inner wall and an outer wall, the two walls being substantially perpendicular to the plane of the sheet material, and wherein the channel opens at the front surface of the panel for the sheet material to be slotted into;

wherein the first edge portion of the sheet material has been adapted to create a region of stiffened edging that is located within the channel of the first frame member and the second edge portion of the sheet material is gripped within a resilient slot formed by gripper members provided in the channels of the remaining frame members, wherein an edge of the second edge portion opposite to the first edge portion is not provided with a region of stiffened edging;

wherein each gripper member is inserted into the channel of its frame member to provide at least one resilient gripper element in the channel of its frame member; and wherein the gripper elements are flaps which act to close off the channels to provide the resilient slot and the gripper elements are configured to resiliently deflect or deform when the sheet material is inserted into the resilient slot, and wherein the gripper member clips onto the inner wall of its frame member when the gripper member is inserted into the channel of its frame member.

2. A panel as claimed in claim 1, wherein the first and second frame portions consists of frame members having the same profile.

3. A panel as claimed in claim 2, wherein the frame is a rectangular frame.

4. A panel as claimed in claim 1, wherein the region of stiffened edging has a thickness substantially corresponding to a width of the channel.

5. A panel as claimed in claim 1, wherein the region of stiffened edging has a thickness substantially less than a width of the channel, and wherein the first edge portion of the sheet material is also held by a resilient slot formed by a gripper element of a gripper member provided in the channel of the first frame portion.

6. A panel as claimed in claim 1, wherein the region of stiffened edging comprises a strip of material that has been attached to an edge of the sheet material.

7. A panel as claimed in claim 6, wherein a width of the strip material, which extends in a depth direction of the channel, is greater than the width of the channel.

8. A panel as claimed in claim 1, wherein the channel of at least the first frame member extends at an angle of greater than 80° to a plane defined by the sheet material.

9. A panel as claimed in claim 8, wherein the channel of at least the first frame member extends at an angle substantially perpendicular to the plane defined by the sheet material.

10. A panel as claimed in claim 1, wherein the frame portions include a formation to retain a gripper member.

11. A panel as claimed in claim 10, wherein each gripper member comprises a body, which has been moulded from a first composition and is configured to lock onto a wall forming the channel in a frame portion, and at least one projection, which has been moulded from a second composition that is different to the first composition, the at least one projection being arranged to resist the pulling out of the sheet material from the channel.

12. A panel as claimed in claim 1, wherein the sheet material is fabric.

13. A panel as claimed in claim 1, wherein the panel includes back illumination, and only a region corresponding to the width of the channel is not illuminated.

14. A method of assembling a panel having a front surface and comprising a frame and sheet material, the method comprising:

assembling the frame from a plurality of frame members, the frame extending around the panel and the frame having a first frame portion provided by a first frame member and a second frame portion consisting of remaining frame members, each frame member having a longitudinal channel;

providing a gripper member in the channel of each of the frame members of the second frame portion, the gripper members forming a resilient slot in the second frame portion;

providing sheet material to extend in a plane across the frame between the first and second frame portions to form a body of the panel, the sheet material having edges defining a periphery, a first edge portion and a second edge portion of the sheet material, wherein the first edge portion of the sheet material is a first edge which has been adapted so as to provide a region of stiffened edging and the second edge portion consists of remaining edges of the sheet material, wherein an edge of the second edge portion opposite to the first edge portion is not provided with a region of stiffened edging;

inserting the region of stiffened edging into the channel of the first frame member in order to locate the first edge portion of the sheet material with respect to the panel;

inserting the second edge portion of the sheet material into the resilient slot provided by the gripper members of the second frame portion to locate the second edge portion of the sheet material with respect to the panel, such that the sheet material is retained about its entire periphery by being inserted into the channels of the respective frame members of the first and second frame portions; and pulling the sheet material taut through pushing the second edge portion of the sheet material into the gripper members of the second frame portion;

wherein each channel is defined by two walls of the respective frame member, an inner wall and an outer wall, the two walls being substantially perpendicular to the plane of the sheet material, and wherein the channel opens at the front surface of the panel for the sheet material to be slotted into, wherein each gripper member provides at least one gripper element in the form of a flap which acts to close off the channel to provide the resilient slot and the gripper element is configured to resiliently deflect or deform when the sheet material is inserted into the resilient slot, and wherein the gripper member clips onto the inner wall of its frame member when the gripper member is inserted into the channel of its frame member.

15. A method as claimed in claim 14 comprising:

providing a gripper member by inserting and fixing a gripper member to a second frame portion.

16. A method as claimed in claim 14 comprising:

attaching a flexible strip to a second edge portion of the sheet material to form the region of stiffened edging.

17. A panel having a front surface and comprising:

a frame; and sheet material;

the frame comprising a plurality of frame members assembled into the frame extending around the panel, the frame having a first frame portion provided by first and second frame members and a second frame portion consisting of remaining frame members, and each frame member being provided with a longitudinal channel;

sheet material having edges defining a periphery of the sheet material, the sheet material extending in a plane across the frame between the frame portions, wherein first and second edges forming a first edge portion of the sheet material, are inserted into the channels of the first and second frame members, and a second edge portion of the sheet material, consisting of remaining edges, is inserted into the channels of the remaining frame members, such that the sheet material is retained about its entire periphery by being inserted into the channels of respective frame members of the first and second frame portions;

wherein each channel is defined by two walls of the respective frame member, an inner wall and an outer wall, the two walls being substantially perpendicular to the plane of the sheet material, and wherein the channel opens at the front surface of the panel for the sheet material to be slotted into;

wherein the first edge portion of the sheet material has been adapted to create regions of stiffened edging along the first and second edges that are located within the channels of the first and second frame members and the second edge portion of the sheet material is gripped within a resilient slot formed by gripper members provided in the channels of the remaining frame members, wherein an edge of the second edge portion opposite to the first edge portion is not provided with a region of stiffened edging, wherein each gripper member is inserted into the channel of its frame member to provide at least one resilient gripper element in the channel of its frame member;

wherein the gripper elements are flaps which act to close off the channels to provide the resilient slot and the gripper elements are configured to resiliently deflect or deform when the sheet material is inserted into the resilient slot; and wherein the gripper member clips onto the inner wall of its frame member when the gripper member is inserted into the channel of its frame member.

18. A method of assembling a panel having a front surface and comprising a frame and sheet material, the method comprising:

assembling the frame from a plurality of frame members, the frame extending around the panel and the frame having a first frame portion provided by first and second frame members and a second frame portion consisting of remaining frame members, each frame member having a longitudinal channel;

providing a gripper member in the channel of each of the frame members of the second frame portion, the gripper members forming a resilient slot in the second frame portion;

providing sheet material to extend in a plane across the frame between the first and second frame portions to form a body of the panel, the sheet material having edges defining a periphery, a first edge portion and a second edge portion of the sheet material, wherein the first edge portion of the sheet material are first and second edges which have been adapted so as to provide regions of stiffened edging along the first and second edges, and the second edge portion consists of remaining edges of the sheet material, wherein an edge of the second edge portion opposite to the first edge portion is not provided with a region of stiffened edging;

inserting the regions of stiffened edging into the channels of the first and second frame members in order to locate the first edge portion of the sheet material with respect to the panel;

inserting the second edge portion of the sheet material into the resilient slot provided by the gripper members of the second frame portion to locate the second edge portion of the sheet material with respect to the panel, such that the sheet material is retained about its entire periphery by being inserted into the channels of the respective frame members of the first and second frame portions; and pulling the sheet material taut through pushing the second edge portion of the sheet material into the gripper members of the second frame portion;

wherein each channel is defined by two walls of the respective frame member, an inner wall and an outer wall, the two walls being substantially perpendicular to the plane of the sheet material, and wherein the channel opens at the front surface of the panel for the sheet material to be slotted into, wherein each gripper member provides at least one gripper element in the form of a flap which acts to close off the channel to provide the resilient slot and the gripper element is configured to resiliently deflect or deform when the sheet material is inserted into the resilient slot, and wherein the gripper member clips onto the inner wall of its frame member when the gripper member is inserted into the channel of its frame member.

* * * * *